US010786138B2

(12) United States Patent
Anderson

(10) Patent No.: US 10,786,138 B2
(45) Date of Patent: Sep. 29, 2020

(54) FOOTWEAR CLEANING DEVICE

(71) Applicant: Eartha Anderson, York, PA (US)

(72) Inventor: Eartha Anderson, York, PA (US)

( * ) Notice: Subject to any disclaimer, the term of this patent is extended or adjusted under 35 U.S.C. 154(b) by 0 days.

(21) Appl. No.: 16/250,393

(22) Filed: Jan. 17, 2019

(65) Prior Publication Data

US 2019/0231166 A1 Aug. 1, 2019

Related U.S. Application Data

(60) Provisional application No. 62/709,759, filed on Jan. 30, 2018.

(51) Int. Cl.
*A47L 23/02* (2006.01)
*A47L 23/18* (2006.01)
*A47L 23/26* (2006.01)

(52) U.S. Cl.
CPC ..... *A47L 23/26* (2013.01); *A47L 23/02* (2013.01); *A47L 23/18* (2013.01)

(58) Field of Classification Search
CPC ..... A47L 23/02; A47L 23/18; A47L 23/26
USPC ..... 15/30, 161, 36, 37, 112
See application file for complete search history.

(56) References Cited

U.S. PATENT DOCUMENTS 3,060,475 A * 10/1962 Dufault ..... A47L 23/263 15/36
3,066,338 A * 12/1962 Nappi ..... A47L 23/02 15/34
3,115,653 A * 12/1963 Fresh ..... A47L 23/263 15/37
3,233,266 A * 2/1966 Darby ..... A47L 23/263 15/37
3,737,942 A * 6/1973 Casey ..... A47L 23/02 15/339
3,831,217 A * 8/1974 Odawara ..... A47L 23/02 15/34
3,849,822 A * 11/1974 Ouellette ..... A47L 23/263 15/36
4,118,818 A * 10/1978 Holleran ..... A47L 23/263 15/36
5,964,959 A * 10/1999 Bleth ..... A47L 23/02 134/104.2
6,406,549 B1 6/2002 Berg et al.
(Continued)

FOREIGN PATENT DOCUMENTS

CN 103829906 A 6/2014

OTHER PUBLICATIONS

Abstract of CN 103829906, dated Jun. 4, 2014, 1 page.

*Primary Examiner* — Joseph J Hail
*Assistant Examiner* — Arman Milanian
(74) *Attorney, Agent, or Firm* — Barley Snyder

(57) ABSTRACT

A footwear cleaning device comprises a housing, a brushing system disposed in an interior of the housing, and a spraying system disposed in the interior of the housing. The housing has a lid with an encasement portion. The encasement portion is formed of a semi-rigid, waterproof material and has an opening adapted to receive a footwear and expose only a sole of the footwear to the interior of the housing. The brushing system includes a brush and a driving device driving the brush to have a translational movement with respect to the housing and the sole of the footwear. The spraying system is adapted to spray a cleaning solution on the brush.

18 Claims, 4 Drawing Sheets

(56) References Cited

U.S. PATENT DOCUMENTS 6,668,842 B1* 12/2003 Wilke ..... A47L 23/02 134/113
7,500,488 B1* 3/2009 Long ..... B08B 3/02 134/133
7,676,876 B1* 3/2010 Ewert ..... A47L 23/02 15/30
8,533,901 B2 9/2013 Williams
8,973,197 B2 3/2015 Omidi
9,101,260 B2 8/2015 Desu-Kalyanam
9,380,927 B2 7/2016 Nappi, Sr.
9,609,984 B1* 4/2017 Kelly ..... A47K 7/04
2002/0152566 A1* 10/2002 Nappi, Sr. ..... A47L 23/02 15/36
2002/0189039 A1* 12/2002 Schlem ..... A47L 23/02 15/104.92
2003/0051300 A1* 3/2003 Ferrari ..... A47L 23/02 15/36
2007/0271715 A1 11/2007 Scoralle
2008/0256728 A1* 10/2008 Feeg ..... A47L 23/263 15/34
2009/0038096 A1* 2/2009 Hollander ..... A47L 23/263 15/161
2010/0306935 A1* 12/2010 De Florian ..... A47L 23/02 15/30
2011/0197380 A1* 8/2011 Back ..... A47L 23/02 15/97.2
2012/0167325 A1* 7/2012 Omidi ..... A47L 23/263 15/210.1
2012/0167338 A1* 7/2012 Williams ..... A47L 23/263 15/380
2014/0116468 A1* 5/2014 Craven ..... A47L 23/02 134/18
2014/0196235 A1* 7/2014 Nappi, Sr. ..... A47L 23/26 15/161
2014/0202504 A1* 7/2014 Braaten ..... A47L 23/205 134/57 R
2014/0305470 A1* 10/2014 Desu-Kalyanam ..... A47L 23/263 134/6
2016/0174807 A1* 6/2016 Cruz ..... A47L 23/02 15/36
2016/0345800 A1 12/2016 MacIntyre et al.
2017/0042405 A1 2/2017 Choi et al.
2018/0042449 A1 2/2018 Ori

* cited by examiner

FOOTWEAR CLEANING DEVICE

CROSS-REFERENCE TO RELATED APPLICATION

This application claims priority under 35 U.S.C. § 119 to U.S. Provisional Patent Application No. 62/709,759 filed Jan. 30, 2018.

FIELD OF THE INVENTION

The present invention relates to a cleaning device and, more particularly, to a cleaning device adapted to clean footwear.

BACKGROUND

During daily wear, footwear gathers debris ranging from visible soil to microscopic bacteria. The footwear is then often worn inside the home, where the debris is spread across the floor, dirtying home articles such as rugs and furniture and potentially increasing the likelihood of illness. A footwear sole in particular gathers the most debris due to its contact with the ground. The sole is often a water-resistant, durable material, while an upper connected to the sole in many pieces of footwear is more a delicate material prone to liquid staining or abrasion.

Cleaning devices have been introduced to clean footwear and limit the spread of debris inside the home. Current cleaning devices often apply rough bristles and/or a liquid cleaning solution to remove debris from the footwear. These cleaning devices, however, do not attempt to isolate the sole of the footwear from the upper of the footwear during cleaning. The application of cleaning solution and abrasive bristles to the upper can ruin the footwear and significantly limits the usefulness of the cleaning device for many pieces of footwear.

SUMMARY

A footwear cleaning device comprises a housing, a brushing system disposed in an interior of the housing, and a spraying system disposed in the interior of the housing. The housing has a lid with an encasement portion. The encasement portion is formed of a semi-rigid, waterproof material and has an opening adapted to receive a footwear and expose only a sole of the footwear to the interior of the housing. The brushing system includes a brush and a driving device driving the brush to have a translational movement with respect to the housing and the sole of the footwear. The spraying system is adapted to spray a cleaning solution on the brush.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
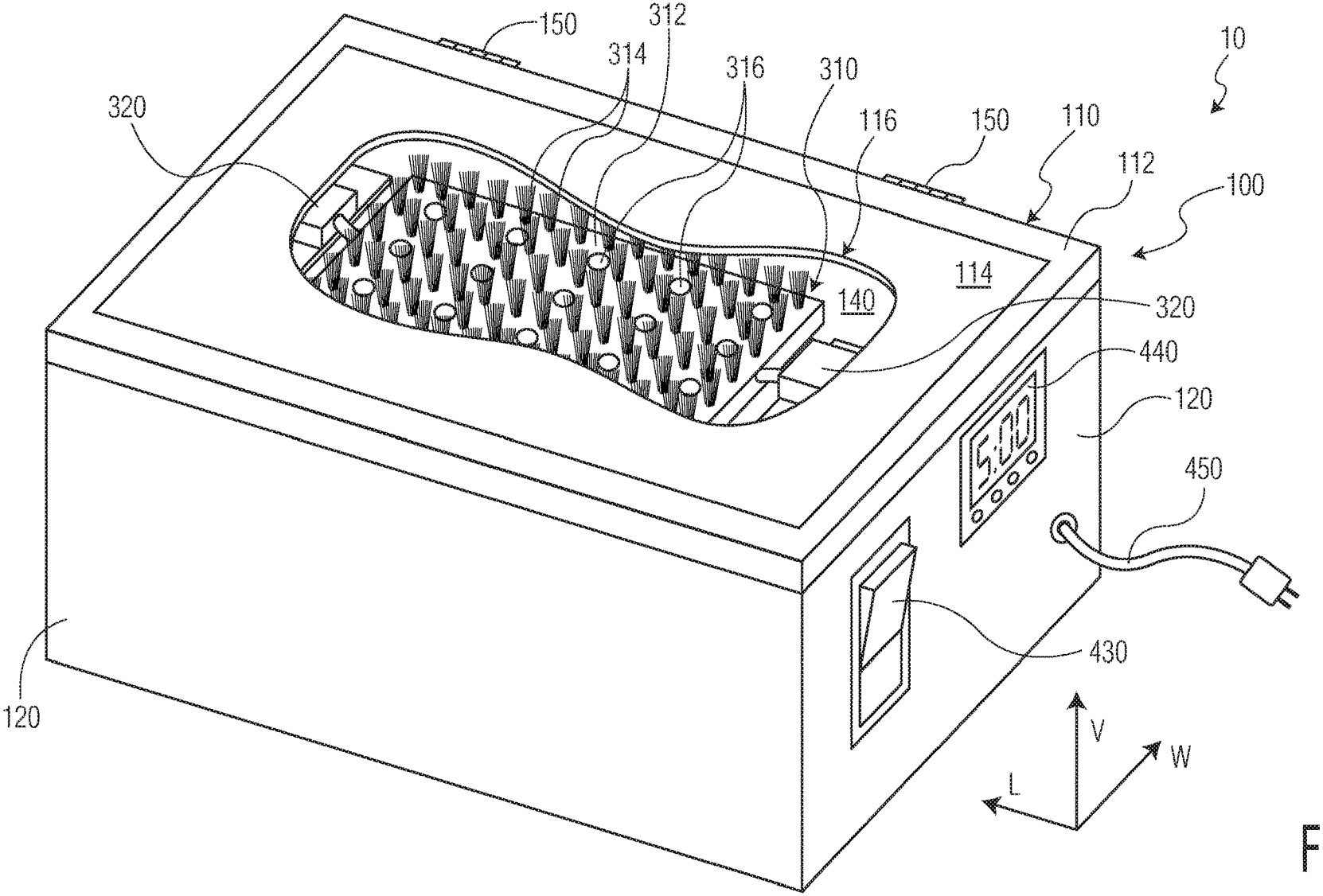
FIG. 1 is a perspective view of a footwear cleaning device according to an embodiment.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the present disclosure will convey the concept of the disclosure to those skilled in the art.

Figure 2:
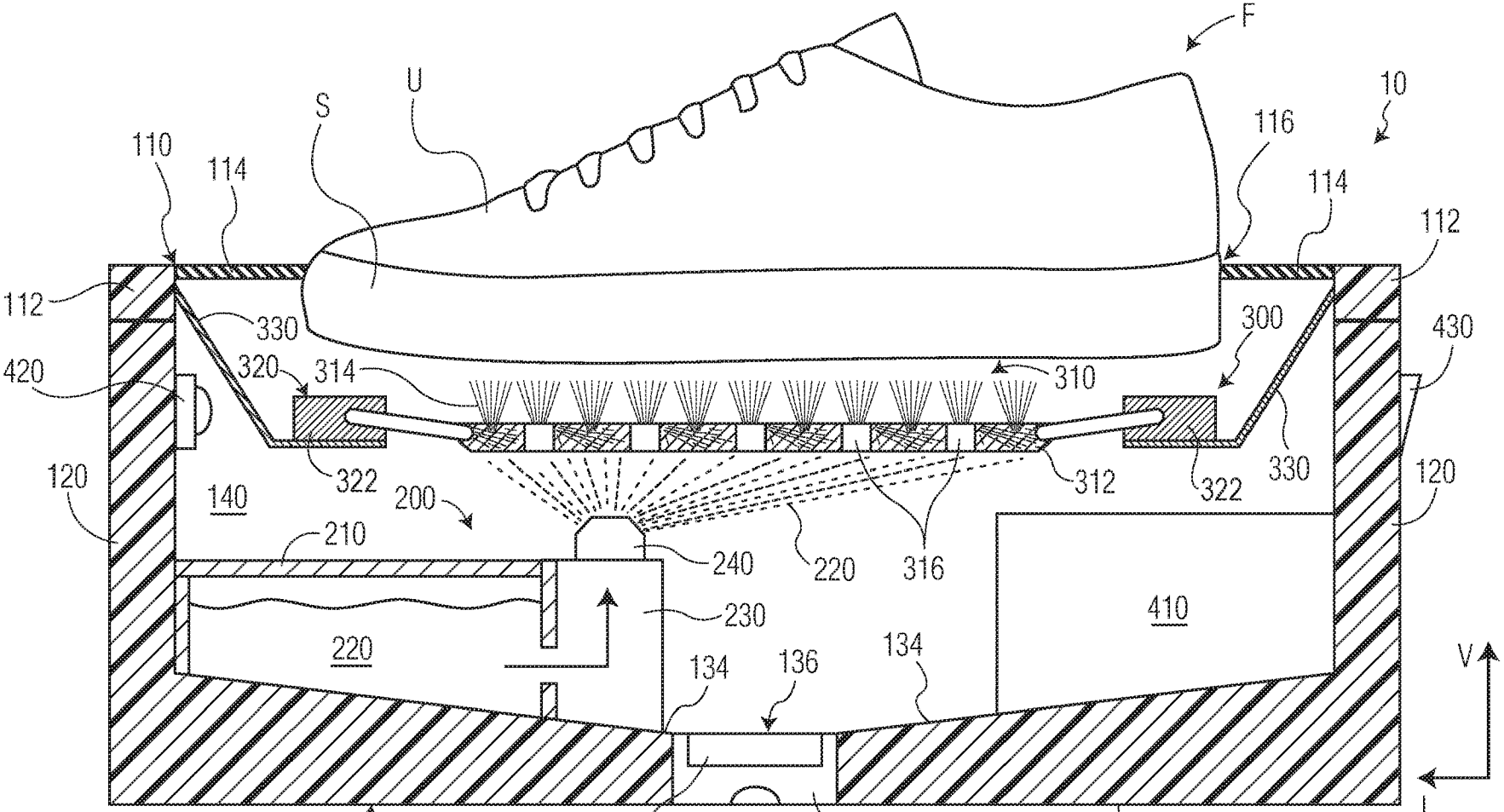
FIG. 2 is a sectional side view of the footwear cleaning device.

A footwear cleaning device 10 according to an embodiment of the invention is shown in FIGS. 1 and 2. The footwear cleaning device 10 includes a housing 100, a spraying system 200 disposed within the housing 100, a brushing system 300 disposed within the housing 100, and a control system 400 disposed within the housing 100 and controlling the spraying system 200 and the brushing system 300.

The housing 100, as shown in FIGS. 1 and 2, includes a lid 110, a plurality of sidewalls 120, and a bottom 130. The lid 110, the sidewalls 120, and the bottom 130 define an interior 140 of the housing 100. In the shown embodiment, the housing 100 has four sidewalls 120 in a rectangular shape with exterior dimensions similar to a shoebox. In other embodiments, the housing 100 may have any other shape provided the footwear cleaning device 10 can function as described herein.

The lid 110, as shown in FIGS. 1 and 2, is connected to the sidewalls 120 and includes a frame 112 and an encasement portion 114 disposed within the frame 112. The frame 112 is a perimeter of the lid 110 and is formed of a hard, strong, and rigid material such as a plastic or a metal. The encasement portion 114 is attached to the frame 112 and is held within the frame 112. In various embodiments, the encasement portion 114 may be attached to the frame 112 by an adhesive or may be fixed to the frame 112 by a fastener.

The encasement portion 114 is formed of a semi-rigid, waterproof material and has an opening 116 disposed approximately centrally in the encasement portion 114. The opening 116 is dimensioned to approximate a shape of a sole S of footwear F, as shown in FIG. 2. The semi-rigid, waterproof material may be a plastic material such as polyethylene, a rubber material, a synthetic rubber material such as neoprene, a composite material, or any other semi-rigid material having waterproof characteristics.

The lid 110 is movable with respect to the sidewalls 120 between an open position in which the interior 140 of the housing 100 is exposed and a closed position, shown in FIGS. 1 and 2, in which the lid 110 encloses a top of the housing 100 in a vertical direction V. In the embodiment shown in FIG. 1, the lid 110 is connected to the sidewalls 120 by a plurality of hinges 150 and is pivotable about one of the sidewalls 120 between the open position and the closed position. In another embodiment, the lid 110 may be unattached from the sidewalls 120 but dimensioned to fit an exterior surface of each of the sidewalls 120, such as with a shoebox lid; in this embodiment, the lid 110 is completely removable from the sidewalls 120 by lifting in the vertical direction V.

The bottom 130, as shown in FIG. 2, is attached to the sidewalls 120 and encloses a bottom of the housing 100 in the vertical direction V. In the shown embodiment, the bottom 130 is integrally formed in a single piece with the sidewalls 120. In various embodiments, the sidewalls 120 and the bottom 130 may be formed of a hard, strong, and rigid material such as a plastic or a metal.

As shown in FIG. 2, an exterior surface 132 of the bottom 130 is flat and an interior surface 134 of the bottom 130 opposite the exterior surface 132, and adjacent the interior 140 of the housing 100, is sloped. The interior surface 134 has a slope terminating in a release passageway 136 extending through the bottom 130 in the vertical direction V. In the shown embodiment, the release passageway 136 is positioned approximately centrally in the bottom 130. In other embodiments, the interior surface 134 is sloped to the release passageway 136 at an off-centered position on the bottom 130.

The bottom 130 includes a release tray 138 removably positioned in the release passageway 136, as shown in FIG. 2. In a secured position of the release tray 138, the release tray 138 is secured to the bottom 130 in the release passageway 136 by, for example, an interference fit or a latch. In a released position of the release tray 138, the release tray 138 is removed from the release passageway 136 by pulling down on the release tray 138 in the vertical direction V and the interior 140 is open to an area exterior of the footwear cleaning device 10. In various embodiments, the release tray 138 may be released from the secured position by, for example, activation of a button to release a latch or application of a removal force by a user to overcome a friction force of an interference fit. The release tray 138 is an approximately square-shaped member that functions similarly to a plug in the bottom 130. In the shown embodiment, the release tray 138 can have a tray receptacle 139 adapted to collect some debris described below. In another embodiment, the release tray 138 is a substantially solid cube or rectangular parallelepiped adapted to fit in the release passageway 136.

The spraying system 200, as shown in FIG. 2, is disposed in the interior 140 of the housing 100 and includes a reservoir 210 retaining a cleaning solution 220, a pump 230 fluidly connected to the reservoir 210, and a nozzle 240 fluidly connected to the pump 230. In the shown embodiment, the spraying system 200 is disposed on the interior surface 134 of the bottom 130. In other embodiments, the spraying system 200 may be secured anywhere within the interior 140 provided the spraying system 200 can perform the functions described herein.

In various embodiments, the cleaning solution 220 is a liquid cleaning solution or a foam cleaning solution. The liquid cleaning solution or the foam cleaning solution may be biodegradable. The liquid cleaning solution may be water or a liquid soap.

As shown in FIG. 2, the pump 230 is fluidly connected to the reservoir 210 and receives the cleaning solution 220 from the reservoir 210. The pump 230 may be any type of small electric fluid pump known to those with ordinary skill in the art. The pump 230 pumps the cleaning solution 220 to the nozzle 240, where the cleaning solution 220 is sprayed over a wide area in the interior 140 by the nozzle 240. The nozzle 240 may be a single directional nozzle capable of moving and rotating to point in different directions, or may be a multidirectional nozzle.

The brushing system 300, as shown in FIG. 2, is disposed in the interior 140 of the housing 100 and includes a brush 310, a driving device 320 connected to the brush 310, and a bracket 330 attached to the lid 110 and supporting the brush 310 and driving device 320.

The brush 310, as shown in FIGS. 1 and 2, includes a brush base 312 and a plurality of bristles 314 attached to and extending from the brush base 312. The brush base 312 is a rigid material and the bristles 314 are each a strand of a stiff, resilient, and durable material extending from the brush base 312 in the vertical direction V. The bristles 314, in various embodiments, may be formed of a natural material such as horsehair, a synthetic material such as nylon or polyethylene, or a wire material such as aluminum or stainless steel. A plurality of brush passageways 316 extend through the brush base 312 in the vertical direction V or a direction of extension of the bristles 314 and are distributed among the bristles 314.

The driving device 320, as shown in FIGS. 1 and 2, is attached to the brush base 312 and is adapted to move the brush 310. The driving device 320 is capable of driving the brush 310 to have a vertical movement and a translational movement with respect to the housing 100. The vertical movement of the brush 310 driven by the driving device 320 is in the vertical direction V, and the translational movement of the brush 310 driven by the driving device 320 is in a width direction W perpendicular to the vertical direction V and in a longitudinal direction L perpendicular to both the vertical direction V and the width direction W. The driving device 320 is capable of linearly driving the brush 310 to move in three dimensions.

In the shown embodiment, the driving device 320 includes two actuators 322 each attached to an end of the brush 310. Each of the actuators 322 is an actuator known to those with ordinary skill in the art that, in response to an electrical signal, is capable of raising and lowering, pushing and pulling, and/or rotating an attached load, such as an electrical motor. In other embodiments, the driving device 320 may be a single actuator 322, or may be any number of actuators 322 or any type of driving device known to those with ordinary skill in the art and capable of driving the vertical and translational movement of the brush 310.

As shown in FIG. 2, the bracket 330 attaches the driving device 320 to the frame 112 of the lid 110. The bracket 330 supports the driving device 320 and the brush 310 such that a weight of the brushing system 300 is supported in the interior 140 entirely by the lid 110 and the brushing system 300 remains attached to the lid 110 as the lid 110 moves between the open position and the closed position. The bracket 330 holds the driving device 320 and the brush 310 in a position under the encasement portion 114 in the vertical direction V. The bracket 330 may be attached to the frame 112 by an adhesive, a fastener, such as a screw, or by integrally forming the bracket 330 with the frame 112. In the shown embodiment in which the driving device 320 includes two actuators 322, for each of the actuators 322, one bracket 330 attaches the actuator 322 to the frame 112. The brushing system 300 may include any number of brackets 330 necessary to hold and support the driving device 320 and the brush 310 from the lid 110.

Figure 3:
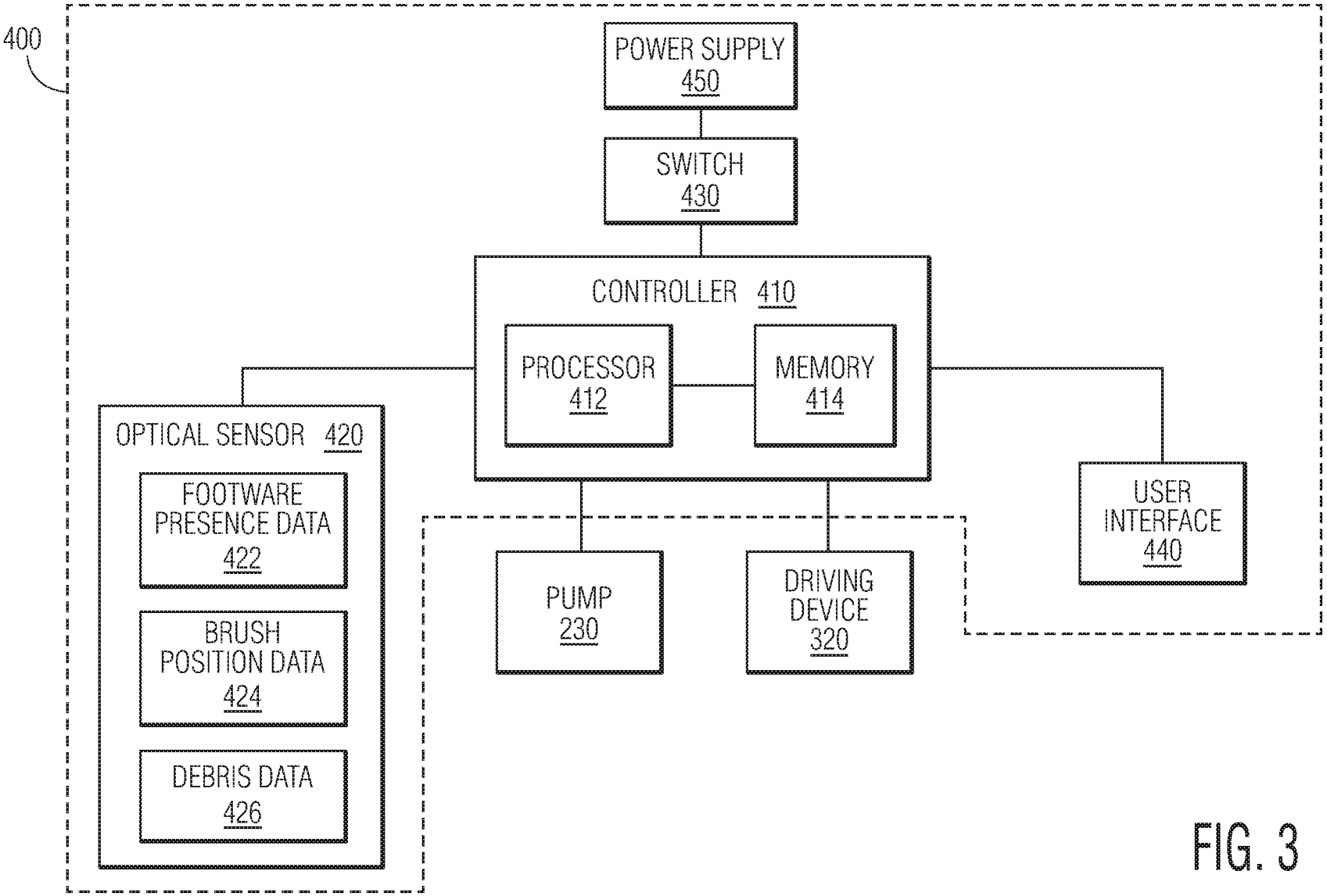
FIG. 3 is a block diagram of a control system of the footwear cleaning device.

The control system 400, as shown in FIGS. 1-3, includes a controller 410 disposed in the interior 140 of the housing 100 and an optical sensor 420, a switch 430, a user interface 440, and a power supply 450 connected to the controller 410.

The controller 410, as shown in FIG. 3, includes a processor 412 and a memory 414 connected to the processor. The memory 414 is a non-transitory computer readable medium, such as read-only memory (ROM), storing computer programs thereon that are executable by the processor 412 the perform the functions of the controller 410 described herein. The controller 410 is connected to the pump 230 of the spraying system 200 and the driving device 320 of the brushing system 300 and is adapted to control the pump 230 and the driving device 320 based on computer programs stored in the memory 414 and executable by the processor 412.

The optical sensor 420, as shown in FIGS. 2 and 3, is disposed in the interior 140 on a sidewall 120 of the housing 100 and is positioned to detect an area around the opening 116 of the encasement portion 114. The optical sensor 420 gathers optical data of the area around the opening 116 of the encasement portion 114, and as shown in FIG. 2, the optical data is related to the sole S of footwear F. As shown in FIG. 3 and described in greater detail below, the optical sensor 420 is adapted to gather footwear presence data 422, brush position data 424, and debris data 426 from the area around the opening 116 and the sole S of footwear F. The optical sensor 420 may be a photodetector, an imaging device such as a camera, or an infrared sensor. The optical sensor 420 is connected to the controller 410 and transmits the optical data to the controller 410.

The switch 430, as shown in FIGS. 1-3, is disposed on an exterior of a sidewall 120 and connects the controller 410 to the power supply 450. The switch 430 is movable between an activated position in which power is supplied from the power supply 450 to the controller 410 and a deactivated position in which no power is supplied to the controller 410. The power supply 450 may be a corded power supply connectable to an outlet, as shown in the embodiment of FIG. 1, or may be a set of batteries disposed on a sidewall 120.

The user interface 440, as shown in FIGS. 1 and 3, is disposed on an exterior of a sidewall 120 and is connected to the controller 410. The user interface 440, in various embodiments, is adapted to output information received from the controller 410 to a user and may also be adapted to receive input information from the user and transmit the input information to the controller 410. The user interface 440 may be a display screen, a touchscreen, or any other type of interface capable of outputting information and/or receiving input information.

Figure 4:
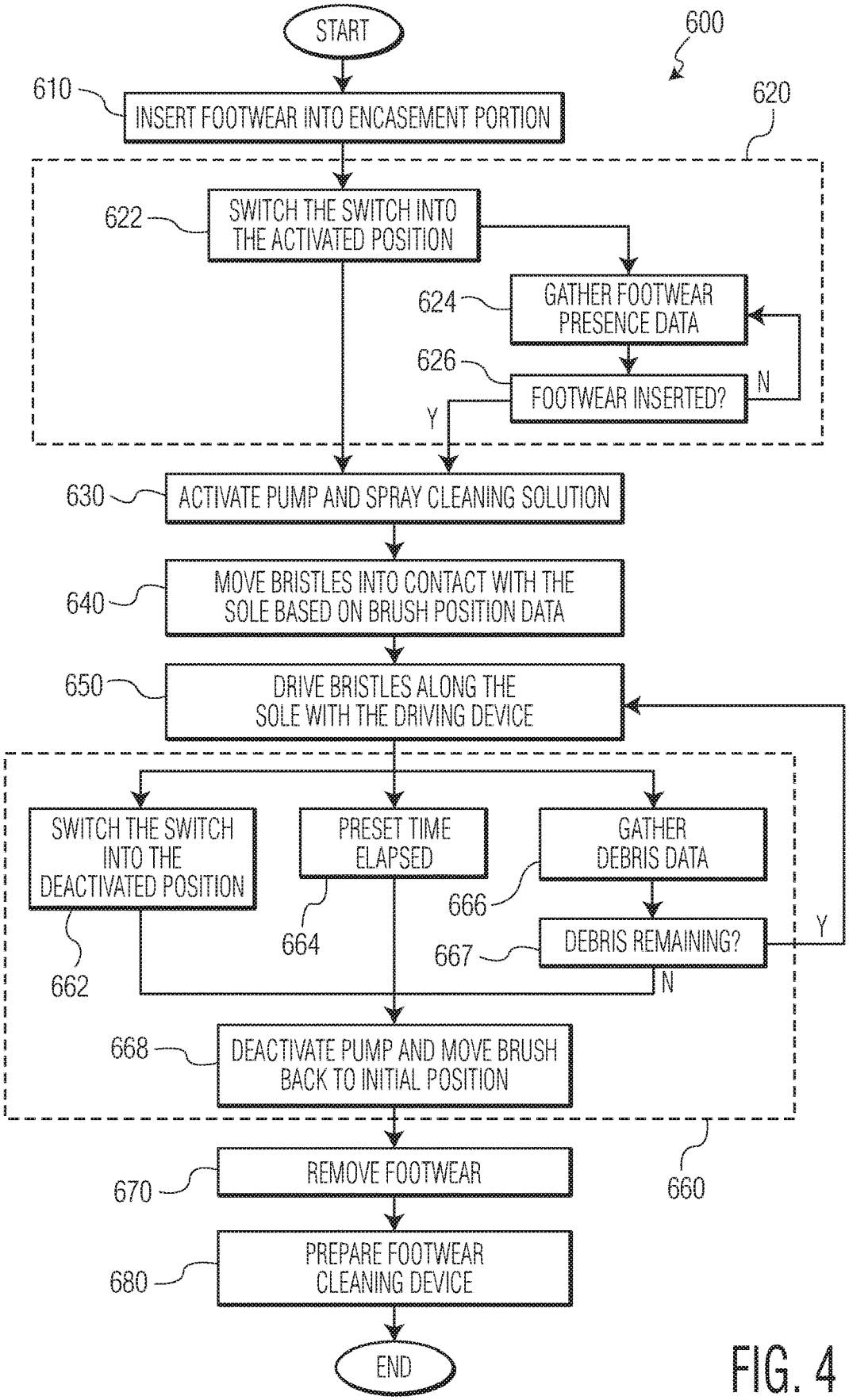
FIG. 4 is a flow diagram of a process of using the footwear cleaning device.

A process 600 of using the footwear cleaning device 10 to clean the footwear F is shown in FIG. 4 and will now be described in greater detail with reference to FIGS. 1-4.

As shown in FIG. 2, with the lid 110 in the closed position, the footwear F is inserted into the opening 116 of the encasement portion 114 in a first step 610 shown in FIG. 4. The semi-rigid, waterproof material of the encasement portion 114 engages the footwear F such that the footwear F is held in the opening 116 with the sole S of the footwear F positioned in the interior 140 of the housing 100 and an upper U of the footwear F positioned outside of the footwear cleaning device 10. The encasement portion 114 is sufficiently resiliently deflectable to engage the footwear F and act as a waterproof seal encasing the sole S and separating the sole S from the upper U; the encasement portion 114 exposes only the sole S of the footwear F to the interior 140 of the housing 100. The semi-rigid, waterproof material of the encasement portion 114 is sufficiently rigid to individually support a weight of the footwear F and hold the footwear F in a position suspended in the interior 140, as shown in FIG. 2.

The semi-rigid, waterproof material of the encasement portion 114 is resiliently deflectable such that the opening 116 can accommodate footwear F of a plurality of different sizes and can accept the sole S of either a right or a left piece of footwear F. In an embodiment, in order to accommodate a wider range of footwear F sizes, the encasement portion 114 is removable from the frame 112, and encasement portions 114 with different sized openings 116 are interchangeably attachable to the frame 112.

With the footwear F held in the opening 116 of the encasement portion 114, the controller 410 initializes a cleaning of the sole S in a second step 620 shown in FIG. 4. The controller 410 can only initialize the cleaning of the sole S when the user has switched the switch 430 into the activated position in a step 622 and power is supplied from the power supply 450 to the controller 410. In an embodiment, the controller 410 initializes the cleaning described below as soon as the user switches the switch 430 into the activated position.

In another embodiment, the optical sensor 420 gathers footwear presence data 422 indicating a presence or an absence of footwear F in the opening 116 and transmits the footwear presence data 422 to the controller 410 in a step 624 shown in FIG. 4. The controller 410 determines whether the footwear presence data 422 indicates that footwear F has been inserted into the opening 116 or whether the footwear presence data 422 indicates that no footwear F has been inserted into the opening 116 in a step 626. In this embodiment, the controller 410 only initializes the cleaning described below when both the switch 430 is in the activated position and the footwear presence data 422 from the optical sensor 420 indicates that the footwear F has been inserted in the opening 116. If the controller 410 determines that the footwear F has not been inserted in the opening 116, the controller 410 loops back and continues to gather footwear presence data 422 from the optical sensor 420.

The controller 410 initializes the cleaning by executing programs controlling the pump 230 and the driving device 320.

The controller 410 activates the pump 230 and controls the pump 230 to spray the cleaning solution 220 through the nozzle 240 in a third step 630, as shown in FIGS. 2 and 4. The cleaning solution 220 sprayed from the nozzle 240 travels through the brush passageways 316 and saturates the bristles 314.

Later or simultaneously, in a fourth step 640 shown in FIG. 4, the optical sensor 420 gathers brush position data 424 indicating a relative position between the bristles 314 and a bottom of the sole S and transmits the brush position data 424 to the controller 410. The controller 410 determines from the brush position data 424 whether the bristles 314 are in contact with the bottom of the sole S and, based on this determination, the controller 410 controls the driving device 320 to move the bristles 314 into contact with the bottom of the sole S in the vertical direction V.

With the bristles 314 in contact with the bottom of the sole S, the controller 410 controls the driving device 320 to move translationally along the bottom of the sole S in a fifth step 650 shown in FIG. 4. The bristles 314 engage the sole S and dislodge debris from the sole S during translational and vertical movement. The debris and cleaning solution 220 fall to the interior surface 134 of the bottom 130 and are moved by gravity into the release tray 138 disposed in the release passageway 136. In various embodiments, the controller 410 can control the spraying system 200 to only spray the cleaning solution 220 at the initialization of cleaning, can control the spraying system 200 to spray continuously throughout the cleaning, or can control the spraying system 200 to spray periodically throughout the cleaning.

The driving device 320 continues to drive the bristles 314 along the sole S until the controller 410 ends the cleaning in a sixth step 660 shown in FIG. 4. In all embodiments, the controller 410 can end the cleaning when the user manually moves the switch 430 into the deactivated position in a step 662. The controller 410 can also determine to end the cleaning according to a number of different embodiments described below. At the end of cleaning, the controller 410 deactivates the pump 230 and controls the driving device 320 to move the brush 310 back into an initial position in a step 668.

In an embodiment, the controller 410 ends the cleaning after a preset time has elapsed in a step 664 shown in FIG. 4. In this embodiment, the controller 410 displays the preset time on the user interface 440 and the user interface 440 counts down from the preset time to indicate a remaining time and the end of cleaning to the user on the user interface 440.

In another embodiment, the optical sensor 420 gathers debris data 426 indicating the presence or absence of debris on the sole S and transmits the debris data 426 to the controller 410 in a step 666 shown in FIG. 4. The controller 410 receives the debris data 426 and determines whether the debris data 426 indicates that debris remains on the sole S in a step 667. If the controller 410 determines that debris remains on the sole S, the controller 410 continues to control the driving device 320 to move the brush 310 and the spraying system 200 to spray the cleaning solution 220. The controller 410 ends the cleaning when the debris data 426 indicates that no debris remains on the sole S. In an embodiment, the controller 410 may indicate an estimated time remaining on the user interface 440 based on the debris data 426.

Other embodiments may combine the preset time and the use of the optical sensor 420 to gather debris data 426. For example, in an embodiment, the controller 410 may only receive the debris data 426 from the optical sensor 420 after the controller 410 has at least conducted cleaning for the preset time.

In all embodiments, the controller 410 may control the user interface 440 to provide a sound or other alert to the user to indicate the end of cleaning.

The footwear F is removed from the opening 116 when the cleaning is completed in a seventh step 670 shown in FIG. 4. The encasement portion 114 allows the sole S to be thoroughly cleaned by the spraying system 200 and the brushing system 300 without the cleaning solution 220 contacting the upper U of the footwear F.

After cleaning of the footwear F is completed, or as needed periodically, the user can prepare the footwear cleaning device 10 for future use in an eighth step 680 shown in FIG. 4. The user removes the release tray 138 from the release passageway 136 in the vertical direction V. Due to the slope of the interior surface 134 of the bottom 130, the release tray 138 contains used cleaning solution 220 and debris. Additional cleaning solution 220 and debris can exit the interior 140 through the release passageway 136 with the release tray 138 removed. The release tray 138 can then be cleaned and re-inserted to the secured position in the release passageway 136. Additionally, the user moves the lid 110 to the open position in which the interior 140 of the housing 100 is exposed. The interior 140 of the housing 100 can then be cleaned and the reservoir 210 can be filled with additional cleaning solution 220 as necessary. The brushing system 300 remains attached to the lid 110 when the lid 110 is moved to the open position to permit easier access to the interior 140 and the reservoir 210. When the lid 110 is moved back to the closed position, the footwear cleaning device 10 is ready to clean another piece of footwear F.

What is claimed is:

1. A footwear cleaning device, comprising: a housing having a lid with an encasement portion, the encasement portion is formed of a semi-rigid waterproof material and has an opening adapted to receive a footwear and expose only a sole of the footwear to an interior of the housing, the semi-rigid, waterproof material of the encasement portion forms a waterproof seal contacting an outer periphery of the footwear between the sole and an upper of the footwear; a brushing system disposed in the interior of the housing, the brushing system including a brush and a driving device driving the brush to have a translational movement with respect to the housing and the sole of the footwear; and a spraying system disposed in the interior of the housing and adapted to spray a cleaning solution on the brush.

2. The footwear cleaning device of claim 1, wherein the spraying system includes a pump and a nozzle fluidly connected to the pump, the pump is adapted to pump the cleaning solution through the nozzle to spray the cleaning solution.

3. The footwear cleaning device of claim 2, wherein the spraying system includes a reservoir disposed in the interior of the housing and retaining the cleaning solution, the reservoir is fluidly connected to the pump.

4. The footwear cleaning device of claim 3, wherein the cleaning solution is water, a liquid soap, or a foam.

5. The footwear cleaning device of claim 1, wherein the brush includes a brush base and a plurality of bristles attached to and extending from the brush base, the brush base has a plurality of brush passageways extending through the brush base through which the cleaning solution is sprayed to saturate the bristles.

6. The footwear cleaning device of claim 1, wherein the brushing system includes a bracket attaching the driving device to a frame of the lid and the lid supports the brushing system.

7. The footwear cleaning device of claim 6, wherein the housing includes a plurality of sidewalls and a bottom defining the interior of the housing with the lid, the lid is movable with respect to the sidewalls between an open position in which the interior of the housing is exposed and a closed position in which the lid encloses the interior of the housing.

8. The footwear cleaning device of claim 7, wherein the bottom has a sloped interior surface adjacent the interior of the housing, the sloped interior surface terminates in a release passageway extending through the bottom.

9. The footwear cleaning device of claim 8, wherein the housing includes a release tray removably positioned in the release passageway.

10. The footwear cleaning device of claim 1, wherein the semi-rigid, waterproof material of the encasement portion is sufficiently rigid to support a weight of the footwear and hold the footwear in a position suspended in the interior of the housing.

11. The footwear cleaning device of claim 1, further comprising a control system including a controller disposed in the interior of the housing, an optical sensor disposed in the interior of the housing and connected to the controller, and a switch connected to the controller.

12. The footwear cleaning device of claim 11, wherein the controller activates the spraying system to spray the cleaning solution and controls the driving device to drive the brush with the switch in an activated position, and the controller deactivates the spraying system and controls the driving device to drive the brush to an initial position with the switch in a deactivated position.

13. The footwear cleaning device of claim 11, wherein the optical sensor gathers debris data indicating a presence or absence of debris on the sole and transmits the debris data to the controller, the controller determines whether to deactivate the spraying system and control the driving device to drive the brush to an initial position based on the debris data.

14. The footwear cleaning device of claim 12, wherein the optical sensor gathers footwear presence data indicating a presence or an absence of the footwear in the opening of the encasement portion and transmits the footwear presence data to the controller, the controller activates the spraying system to spray the cleaning solution and controls the driving device to drive the brush if the controller determines that the footwear has been inserted into the opening based on the footwear presence data.

15. The footwear cleaning device of claim 14, wherein the optical sensor gathers brush position data indicating a relative position between a plurality of bristles of the brush and the sole and transmits the brush position data to the controller, the controller controls the driving device to drive the brush into a position in which the bristles contact the sole based on the brush position data.

16. The footwear cleaning device of claim 12, wherein the controller deactivates the spraying system and controls the driving device to drive the brush to the initial position after a preset time has elapsed from when the controller activated the spraying system to spray the cleaning solution and began controlling the driving device to drive the brush.

17. The footwear cleaning device of claim 16, wherein the control system includes a user interface disposed on the housing and the controller displays a remaining time from the preset time on the user interface.

18. The footwear cleaning device of claim 13, wherein the control system includes a user interface disposed on the housing and the controller displays an estimated time remaining on the user interface based on the debris data.

* * * * *